US005886506A

United States Patent [19]

Ozawa

[11] Patent Number: 5,886,506

[45] Date of Patent: Mar. 23, 1999

[54] POWER SUPPLY CIRCUIT

[75] Inventor: Akio Ozawa, Kawagoe, Japan

[73] Assignee: Pioneer Electronic Corporation, Tokyo-to, Japan

[21] Appl. No.: 921,468

[22] Filed: Sep. 2, 1997

[30] Foreign Application Priority Data

Sep. 3, 1996 [JP] Japan ..... 8-252289

[51] Int. Cl.[6] ..... G05F 1/613

[52] U.S. Cl. ..... 323/222; 323/285

[58] Field of Search ..... 323/222, 282, 323/285; 363/124

[56] References Cited

U.S. PATENT DOCUMENTS

| | | | |
|---|---|---|---|
| 4,318,164 | 3/1982 | Onodera et al. | 323/222 |
| 4,530,043 | 7/1985 | Palm et al. | 323/222 |
| 5,270,636 | 12/1993 | Lafferty | 323/222 |
| 5,383,109 | 1/1995 | Maksimovic et al. | 323/222 |
| 5,418,709 | 5/1995 | Lukemire | 323/282 |
| 5,502,630 | 3/1996 | Rokhvarg | 323/222 |
| 5,793,190 | 9/1998 | Sahlstrom et al. | 323/222 |

*Primary Examiner*—Jeffrey Sterrett
*Attorney, Agent, or Firm*—Morgan, Lewis & Bockius LLP

[57] ABSTRACT

A power supply circuit for an audio power amplifier or an amplifier of similar operation such as a motor driving amplifier. The power supply circuit comprises a first coil having a first terminal connected to a terminal of a DC voltage source and a second terminal connected to an anode of a first diode, a second coil having a first terminal connected to another terminal of said DC voltage source and a second terminal connected to a cathode of a second diode, a first capacitor connected to a cathode of the first diode and the another terminal of the DC voltage, which accumulates a counter electromotive force generated in the first coil; a second capacitor connected to an anode of the second diode and the another terminal of the DC voltage source, which accumulates a counter electromotive force generated in the second coil; opening and closing device connected across the anode of the first diode and the cathode of the second diode, performing an opening and closing operation, and opening and closing control device connected to the opening and closing device, for controlling the opening and closing operation of the opening and closing device, and amplification device connected across a cathode of the first diode and an anode of the second diode.

3 Claims, 7 Drawing Sheets

(PRIOR APT)

POWER SUPPLY CIRCUIT

BACKGROUND OF THE INVENTION

1. Field of the Invention

The present invention relates to a power supply circuit of an audio signal amplifier or an amplifier having a similar operation, such as a motor drive amplifier, and the like.

2. Description of Related Art

Conventionally, there have been proposed various power supply circuits of an audio amplifier or a motor drive power amplifier and so on, aiming at the reduction of electric power consumption, or the reduction of the size of the power supply circuit as well as its weight.

In the example of a power supply circuit of an audio amplifier, when a high level output signal is produced, the amplitude of the output signal is limited by the voltage of the power-supply being used, although the power-supply voltage is sufficient when the level of the output signal is low. This means that the magnitude of the maximum output signal obtainable from a power amplifier is determined by the power-supply voltage. If a power supply of a high voltage is used so that a sufficient output amplitude is obtained by the amplifier when a high level output signal is produced, the electric power consumption of the power-supply circuit and the power amplifier under the normal operating condition becomes large, resulting in a decrease in efficiency.

In order to eliminate this shortcoming, various systems have been proposed as illustrated in FIG. 1A though FIG. 1C.

The example shown in FIG. 1A is a system which is configured that the power supply voltage is controlled so that it follows the envelope of the peak values of the signal when the output signal is higher than a previously specified value. The example shown in FIG. 1B, on the other hand, is a system configured that the power-supply voltage is controlled to follow the amplitude of the amplifier's output signal.

The example shown in FIG. 1C is a system configured that a plurality of power-supply voltages are supplied for the output signal higher than the specified output signal.

FIG. 2 shows an example of a power-supply circuit for concretely showing the cases shown in FIGS. 1A through 1C.

Referring to FIG. 2, the operation of a power-supply circuit of a voltage control type will be generally explained.

As shown in FIG. 2, a source terminal of a p-type MOSFET (hereinafter, abbreviated as PFET) is connected to a positive terminal of a battery 1 (Vb) which is provided as a power-source. A resistor 3 and a PWM oscillator 4 are connected across the gate and source of the PFET 2, so as to constitute a switch device in which the PFET 2 is switched ON and OFF by the signal from the PWM oscillator 4.

The drain terminal of the PFET 2 is connected to a terminal of a coil 5 whose the other terminal is connected to a ground terminal, and also to a cathode terminal of a diode 6. A capacitor 7 is connected across the anode terminal of the diode 6 and the ground terminal.

To the battery 1, a terminal of a coil 8 is connected, whose the other terminal is connected to a drain terminal of an n-type MOSFET (hereinafter, abbreviated as NFET) 9 and an anode terminal of a diode 10. A resistor 11 and an PWM oscillator 12 are connected across the gate and source of the NFET 9, that is, across the gate of NFET 9 and the ground, so that a switch element in which the NFET 9 is switched ON and OFF by a signal from the PWM oscillator 12 is provided.

A capacitor 13 is connected across the cathode and anode of the diode 10. A capacitor 14 and a load (RL) 15 are connected across the cathode of the diode 10 and the anode of the diode 6.

The power-supply circuit shown in FIG. 2 is a plus-minus two powers supply circuit which is constituted by a minus-chopper circuit generating a minus voltage by the PFET 2, coil 5, diode 6 and capacitor 7, and a plus-chopper circuit generating a plus voltage by the NFET 9, coil 8, diode 10 and capacitor 13.

In the plus-chopper circuit, the current supplied from the battery 1 is accumulated in the coil 8 when the NFET 9 driven by the PWM oscillator 12, which function as a switch element, is turned ON. When the NFET 9 is switched OFF subsequently, a voltage produced by a counter electromotive force of the coil 8 is superimposed on the voltage of the battery 1, so that a positive voltage whose level is higher than the battery voltage (Vb) is produced at a terminal "c" shown in the drawing.

The magnitude of the counter electromotive force produced in this instance is controlled by the pulse width of the pulse signal supplied from the PWM oscillator 12. More particularly, if the pulse width is widened to prolong the period in which the switch element is turned ON, a large counter electromotive force will be generated. Conversely, if the period in which the switch element is turned ON is shortened, a small counter electromotive force will be generated. In the minus chopper circuit, the current supplied from the battery 1 is accumulated in the coil 5 when the PFET 2 driven by the PWM oscillator 4, which functions as a switch element, is turned ON. When the PFET 2 is turned OFF subsequently, a counter electromotive force of the coil 5 is generated with respect to ground, so that a negative voltage is produced at a terminal "d" shown in the drawing. Unlike the operation of the plus chopper circuit, the counter electromotive force is produced with respect to ground so that the battery voltage is not superimposed.

As described above, the voltages produced by two types of chopper circuits are controlled by the pulse widths of the PWM oscillators provided for the switch elements respectively. Therefore, the power-supply voltage can be varied in response to the output signal as depicted in FIGS. 1A through 1C by detecting the output signal or an input signal of the power amplifier and controlling the output pulses of the PWM oscillators by means of a control circuit which is not shown in the drawing.

For example, if the input signal of the power amplifier is within a specified signal voltage range, the operation of the PWM oscillator is stopped, and +12 volts, for example, is produced at the terminal "c" and 0V is produced at the terminal "d", so that the power-supply voltage of 12 volts is supplied to the load.

When, on the other hand, the input signal level is above the specified signal voltage range, the pulse signal is produced by a control signal from the control circuit, and supplied to each switch element. As a result, +16 volts, for example, is produced at the terminal "c" and −4 volts is produced at the terminal "d", so that a power supply voltage of 20 volts is supplied to the load.

OBJECTS AND SUMMARY OF THE INVENTION

As described above, it is general to use a plus-minus dual polarity power supply circuit, which is constituted by two kinds of chopper circuits, in order to realize a power supply circuit capable of efficiently varying the power-supply voltage in response to an output signal of a power amplifier.

The dual polarity power supply circuit is, however, complicated in circuit structure, to cause a higher cost. It is also difficult to make the power supply circuit small in size and light in weight. Furthermore, it is necessary to use two different types of semiconductor elements, such as P type MOSFET and N type MOSFET, as switch elements. In this connection, there arises a further problem of difficulty in obtaining switch element pairs matched in characteristics which include the characteristic changes by environmental conditions.

Consequently, it becomes difficult to adjust the conditions for the two kinds of chopper circuits, so that a large burden is put to the control circuit for controlling the PWM oscillators in terms of its circuit structure and the number of its manufacturing steps.

The present invention has been made in view of the problems described above, and an object of the present invention is to provide a power supply circuit which does not need to use two different kinds of switch elements, having a simple circuit structure, and is of a low cost, and the reduction of its size is possible.

According to a first aspect of the invention, the power supply circuit for generating a power-supply voltage to be supplied to an amplification unit which amplifies an input signal, comprises a DC (direct current) voltage source, a first coil having a first terminal connected to a terminal of the DC voltage source and a second terminal connected to an anode of a first diode, a second coil having a first terminal connected to another terminal of the DC voltage source and a second terminal connected to a cathode of a second diode, a first capacitor connected to a cathode of the first diode and the another terminal of the DC voltage, which accumulates a counter electromotive force generated in the first coil, a second capacitor connected to an anode of the second diode and the another terminal of the DC voltage, which accumulates a counter electromotive force generated in the second coil, opening and closing device connected across the anode of the first diode and the cathode of the second diode, for performing an opening and closing operation, opening and closing control device connected to the opening and closing device, for controlling the opening and closing operation of the opening and closing device, and an amplification device connected across a cathode of the first diode and an anode of the second diode.

According to a second aspect of the invention, in the power supply circuit according to the first aspect of the invention, the opening and closing device comprises a signal level detecting device for detecting a level of an input signal of the amplification device, a power supply voltage detecting device for detecting a power supply voltage supplied to the amplification device, an attenuating device for attenuating the power supply voltage having been detected at a predetermined attenuation factor, and a control signal generating device for generating a control signal which controls the opening and closing operation of the opening and closing device based on a result of a comparison between an output signal of the attenuating device and the input signal level having been detected.

According to a third aspect of the invention, in the power supply circuit according to the first aspect of the invention, the opening and closing device comprises a signal level detecting device for detecting a level of an output signal of the amplification device, a power supply voltage detecting device for detecting a power supply voltage supplied to the amplification device, a first attenuating device for attenuating the power supply voltage having been detected at a predetermined attenuation factor, a second attenuating device for attenuating the level of the output signal having been detected at the predetermined attenuation factor; and a control signal generating device for generating a control signal which controls the opening and closing operation of the opening and closing device based on a result of a comparison between an output signal of the first attenuating device and an output signal of the second attenuating device.

DETAILED DESCRIPTION OF THE PREFERRED EMBODIMENTS

Figure 3:
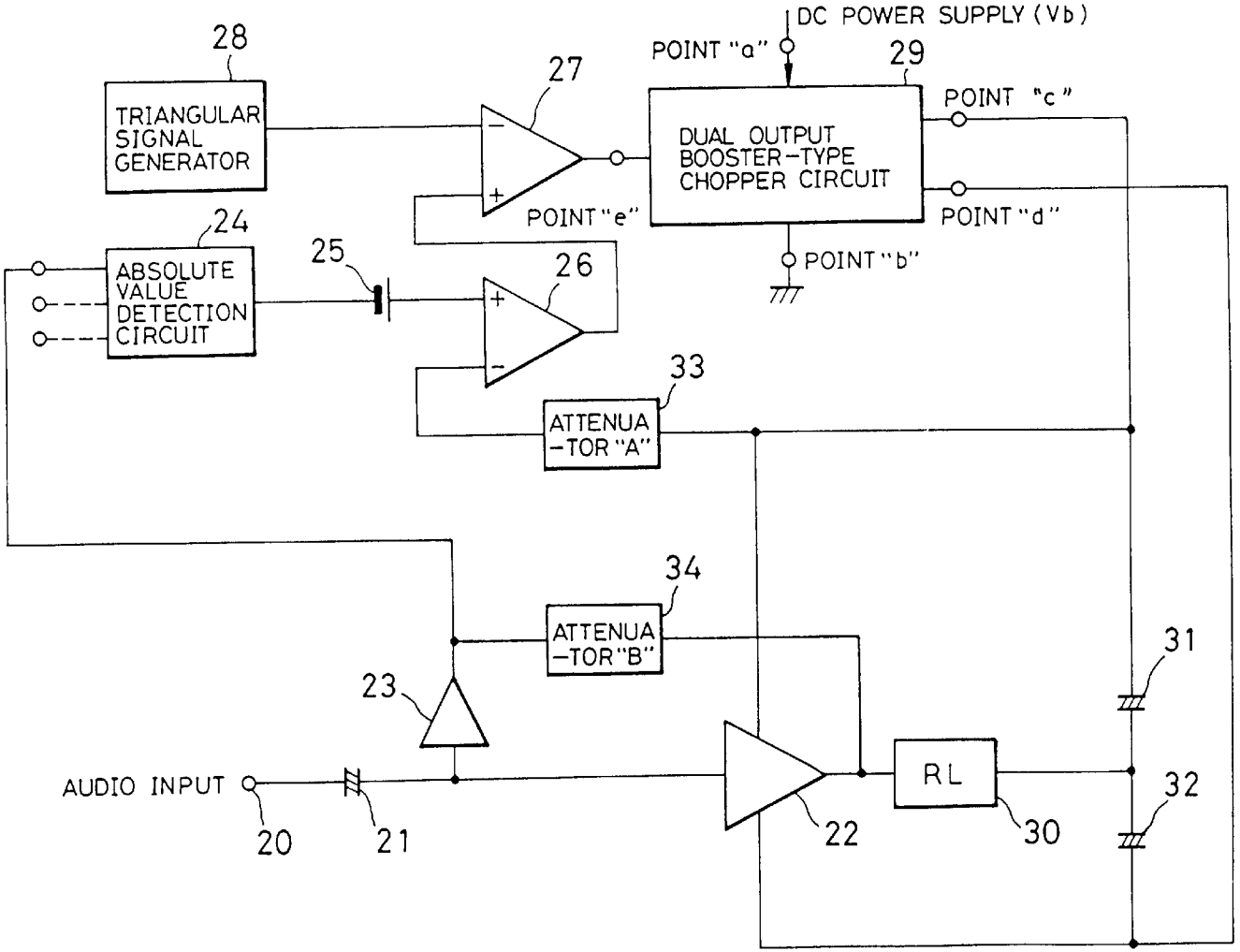
FIG. 3 is a block diagram of a first embodiment of the power supply voltage control circuit according to the present invention.

FIG. 3 is a block diagram of a power supply voltage control circuit in the first embodiment of the power supply circuit according to the present invention and various control devices which are together applied in an audio amplifier.

In FIG. 3, the reference numeral 20 denotes an input terminal of the audio amplifier. A signal received at the input terminal 20 is supplied through a capacitor 21 to an input terminal of a power amplifier 22 functioning as an amplification part.

An amplifier 23 is connected to the input terminal of the amplifier 22, and its output signal is supplied to an absolute value detection circuit 24 functioning as a signal level detection means. The absolute value detection circuit 24 has a plurality of input terminal as provisions for a plurality of power amplifiers of which explanation will be made later. An output signal of the absolute value detection circuit 24 is supplied to a non-inverting input terminal (+) of a comparator 26 provided as a power-supply voltage detecting means, which is one of input terminals thereof, through a dc voltage source 25 provided for compensating for a loss voltage of the power amplifier 22 which will be described later.

An output signal of the comparator 26 is supplied to a non-inverting input terminal (+) of a pulse width modulator 27 provided as a control signal detection means, which is one of the input terminals thereof. A triangular wave generator 28 is supplied to an inverting input terminal (−) of the pulse width modulator 27, and a triangular wave signal of a specified frequency is supplied therefrom.

An output signal of the pulse width modulator 27 is supplied to a terminal e of a dual-output booster type chopper circuit 29 functioning as a power-source circuit. The dual-output booster type chopper circuit 29 is a booster-type chopper circuit that produces two kinds of voltages, i.e., plus and minus voltages (+Vc) and (−Vc), when a voltage (Vb) from a battery provided as a dc power source is supplied at its terminal "a". Each of its output voltages is controlled by a pulse width modulation signal supplied from the pulse width modulator circuit 27.

To the output terminal of the power amplifier 22, there connected is one of the terminals of the load 30, and the other of its terminals is connected to a middle point of two capacitors 31 and 32 which are connected respectively to output terminals of the dual-output booster type chopper circuit 29.

The power supply voltages (±Vc) are supplied to the power amplifier 22 from the dual-output booster type chopper circuit 29. The power amplifier 22 is designed to operate about a voltage (center voltage) of a half of the summed voltage of the voltages (+Vc) and (−Vc) supplied from the dual-output booster type chopper circuit 29 by an operation of an internal bias circuit (not shown) provided therein.

An attenuator "A" 33, which is provided as an attenuating means, is connected to the terminal "c" of the dual-output booster type chopper circuit 29, and an output signal of the attenuator "A" 33 is connected to the inverting input terminal (−) of the comparator 26 described above.

An attenuator "B" 34 to be inserted between the output terminal of the amplifier 22 and the absolute value detection circuit 24 is a circuit used when the detection of signal level (described later) is performed with respect to the output amplitude of the power amplifier 22, and the lines connecting the attenuator "B" are indicated as dashed-lines in the drawing.

The circuit structure of the dual-output booster type chopper circuit 29 used in the power-supply voltage control circuit described above will be explained with reference to FIG. 4.

Figure 4:
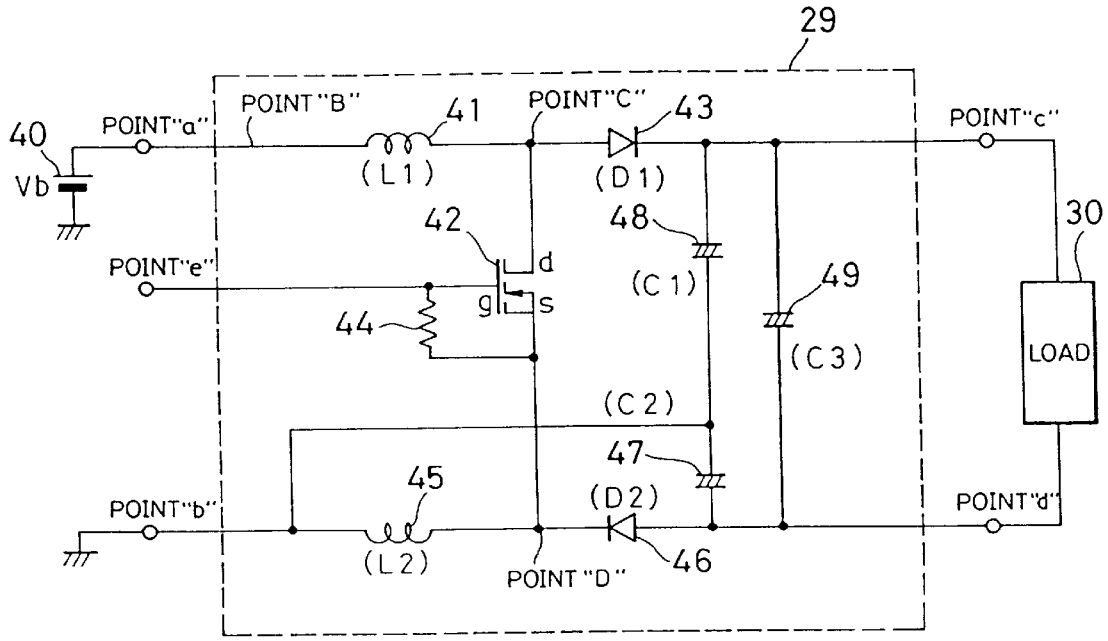
FIG. 4 is a dual-output booster type chopper circuit used in the first embodiment of the power supply voltage control circuit according to the present invention.

In FIG. 4, a drain terminal of an NMOSFET (abbreviated as FET hereinafter) 42 functioning as an opening/closing means and an anode terminal of a first diode "D1" 43 are connected to the terminal "a" of the dual-output booster type chopper circuit 29 through a first coil "L1" 41.

A terminal of a second coil "L2" 45 is connected to the terminal "b", and its the other terminal is connected to the source terminal of the FET 42 and to a cathode terminal of a second diode "D2" 46. The terminal "b" is also connected to a middle point between the two capacitors "C1" 48 and "C2" 47. The other terminals of the capacitors "C2" 47 and "C1" 48 are respectively connected to the anode terminal of the diode "D2" 46 and the cathode terminal of the diode "D1" 43.

The cathode terminal of the diode "D1" 43 is connected to a terminal "c", which functions as a plus voltage output terminal, of the dual-output booster type chopper circuit 29.

The anode terminal of the diode "D2" 46 is connected to its "d" output terminal which functions as a minus voltage output terminal. A capacitor "C3" 49 for the smoothing operation is connected across the terminals "c" and "d".

The connection to each of the terminals of the dual-output booster type chopper circuit 29 is, as illustrated in FIG. 3, that a battery 40 (of 12 Volts, for example) provided as a dc voltage source is connected across the terminals "a" and "b" in such a way that the positive voltage is applied to the terminal "a" and the terminal "b" is a ground terminal. A load 30 such as an amplification device is connected across the terminals "c" and "d".

In the explanation of the operation of the power supply voltage control circuit and the dual output booster-type chopper circuit 29 shown in FIG. 3, the portions which are disclosed in Japanese Patent Application No. H8-131023 assigned to the same assignee of the present application will be explained only briefly.

The operation of the dual-output booster type chopper circuit 29 will be explained first with reference to FIG. 4.

As described above, the battery 40 of +12 Volts is connected to the terminal "a" of the dual-output booster type chopper circuit 29, while its terminal "b" is connected to ground, and the load 30 is connected across the terminals "c" and "d".

When no signal is applied to the terminal "e", or when the voltage at the terminal "e" is low, the FET 42 is in an OFF (non-conductive) state, so that the current supplied from the battery 40 flows into ground through the coil "L1" 41, diode "D1" 43, load 30, diode "D2" 46 and the coil "L2" 45.

When a high-level pulse voltage is applied through the terminal "e", the FET 42 turns "ON", that is, put in a substantially short-circuit state. If it is assumed that the impedance of the coil "L2" 45 is equal to zero, then the connecting node (the point "c" in the figure) between the coil "L1" 41 and the diode "D1" 43 is put to a substantially short-circuit state with the. Therefore, the electric current supplied from the battery 40 is accumulated in the coil "L1" 41.

Subsequently, when the FET 42 turns to the "OFF" state once again, the electric charge accumulated in the coil "L1" 41 will be discharged in the form of counter electromotive force. In this instant, the electric charge value generated by the counter electromotive force is summed on the current by the battery 40, and the summed current flows through the diode "D1" 43, so that a plus voltage (+Vc) which than the voltage (+Vb) of the battery is produced. The operation described in the foregoing is known as the operation of a booster type chopper circuit.

In practice, the impedance of the coil "L2" 45 is not equal to zero, so that the electric charge is accumulated in the coil "L2" 45 when the FET 42 is ON, as in the case of the coil "L1" 41. Subsequently, when the FET 42 is switched to the OFF state again, the electric charge accumulated in the coil "L2" 45 is discharged in the form of counter electromotive force. Since discharge of the counter electromotive force takes place relative to ground, a current of negative polarity is generated at the node between the coil "L2" 45 and the diode "D2" 46 (indicated as a point "D" in the figure), the current passes the diode "D2" 46, so that a minus voltage (−Vc) which is lower than the voltage of the battery 40 is produced at the terminal "d".

Figure 5A:
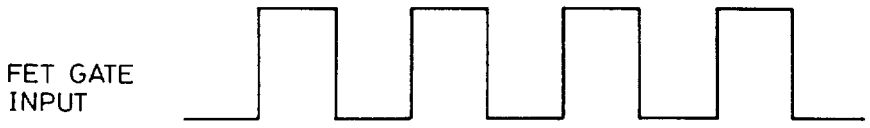
FIGS. 5A and 5B are waveform diagrams showing waveforms at various connection points of the dual-output booster type chopper circuit.
Figure 5B:
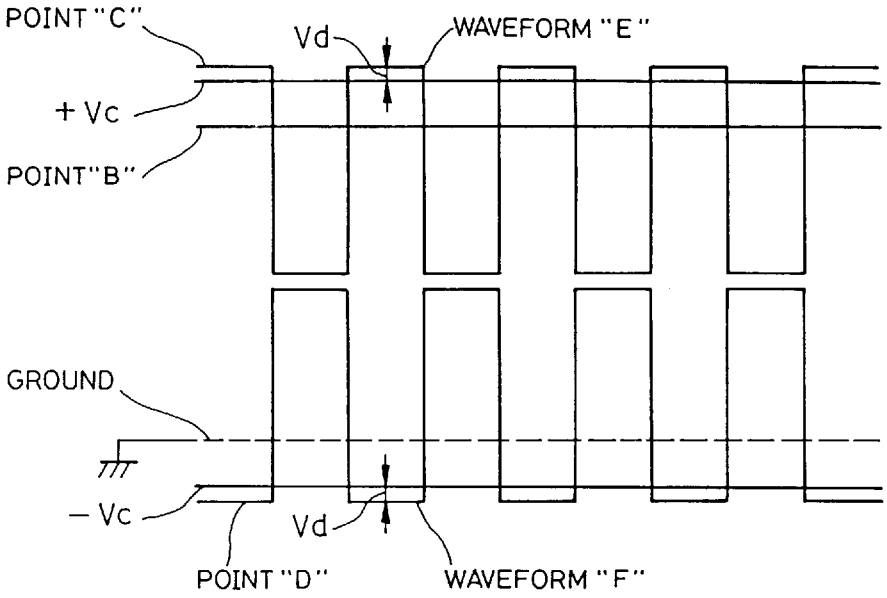

FIGS. 5A and B are diagrams showing the relationship among the voltage waveforms at each connection nodes inside the dual output booster type chopper circuit 29, wherein FIG. 5A shows the waveform of the pulse signal supplied to the terminal "e", and FIG. 5B shows the manner of variation of the electric current when the switching operation of the FET 42 is effected in response to the pulse signal supplied to the gate of the FET 42.

In FIG. 5B, the waveform "E" is the waveform of the booster type chopper circuit for a positive voltage which is constituted by the coil "L1" 41, the diode "D1" 43, the capacitor "C1" 48 and the FET 42. Similarly, the waveform "F" is the waveform of the booster type chopper circuit for a negative voltage which is constituted by the coil "L2" 45, the diode "D2" 46, capacitor "C2" 47, and the FET 42. For the purpose of simplicity, the waveforms "E" and "F", which actually have charge-discharge characteristics, are represented as rectangular waves. In the figure, the part indicated by the letter "G" represents a component by an "ON" resistance of the FET 42 when it is in the conductive state.

Furthermore, the voltage Vd is a loss voltage by the diode when it is in the conductive state, and the output voltages will be lower, by the loss voltage "Vd", than the voltages generated at the points "C" and "D" respectively.

By selecting substantially same values for the pairs of components, namely the coils 41, 45, the diodes 43, 46, the capacitors 47, 48, i.e, satisfying a condition of L1=L2, D1=D2, C1=C2, the voltages boosted in accordance with the pulse signal supplied to the FET 42 can be controlled in manners substantially the same as each other.

Now, an overall operation of the power supply voltage control circuit shown in FIG. 3 will be explained.

A sinusoidal signal having a maximum amplitude of, for example 2 Volts, is supplied at the input terminal 20 of the power supply voltage control circuit. Through the capacitor 21, this sinusoidal signal is supplied to the power amplifier 22 where the signal is amplified. The output signal of the power amplifier 22, whose gain is assumed to be represented by "A", is supplied through the load 30, in such a way that its negative pole signal is supplied to the "d" terminal of the dual-output booster type chopper circuit 29 through the capacitor 32, and its positive pole signal is supplied to the "c" terminal through the capacitor 31.

The sinusoidal signal at the input terminal 20 is also amplified by the amplifier 23, whose gain is assumed to be represented by "B", and supplied to the absolute value detection circuit 24. The absolute value detection circuit 24 is a linear full-wave rectifying circuit which inverts the negative pole signal of the supplied sinusoidal signal to the positive side, and produces the output signal without altering the amplitude value of the supplied sinusoidal signal.

The output signal of the absolute value detection circuit 24 is processed through the addition of a dc voltage (Vth'=Vth/C, described later) by a voltage source 25 provided for compensating for the loss voltage of the power amplifier 22, and supplied to the non-inverting input terminal (+) of the comparator 26.

At the inverting input terminal (−) of the comparator 26, there is supplied a voltage from the terminal "c" of the dual-output booster type chopper circuit 29 after having been attenuated at a ratio of 1/C by an attenuator "A" 33. The attenuator "A" 33 is constituted by a pair of resistors (not illustrated in the figure), and performs the attenuation of the voltage +Vc relative to a middle-point voltage of the two output voltages of the dual-output booster type chopper circuit 29.

The output signal of the comparator 26 is supplied to a non-inverting input terminal (+) of the pulse width modulator 27. At the inverting input terminal (−) of the pulse width modulator 27, there is supplied a triangular signal from the triangular wave generator 28. The pulse width modulator 27 supplies a pulse-width modulated pulse signal, whose ON-OFF times varies in accordance with the output signal of the comparator 26, to the input terminal (the terminal "e") of the dual-output booster type chopper circuit 29.

Figure 6A:
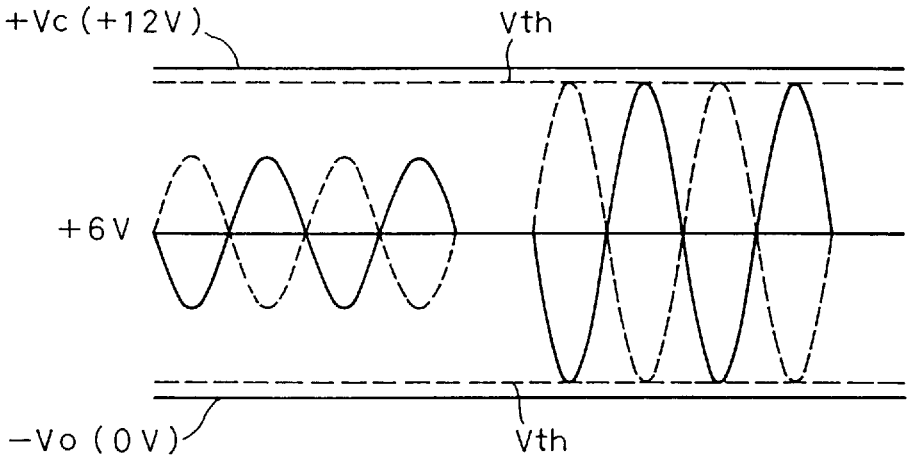
FIGS. 6A and 6B are diagrams showing relationships between the output signal of the power amplifier and the power supply voltage.
Figure 6B:
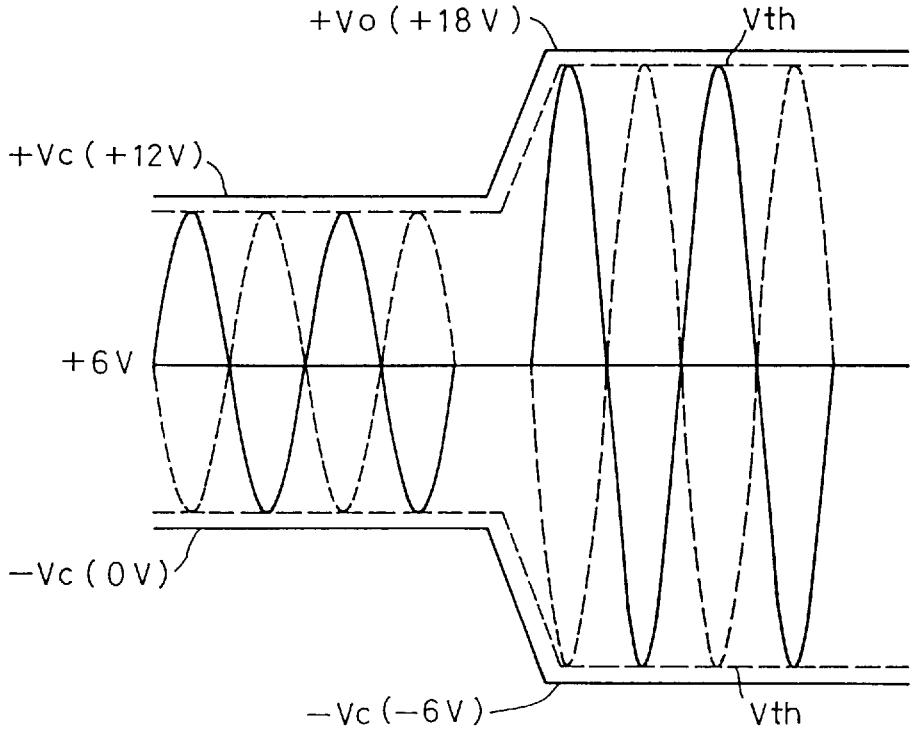

Assume that the FET 42 of the dual-output booster type chopper circuit 29 is in the OFF state in accordance with the output signal of the pulse width modulator 27. In this state, as shown in FIG. 6A, the current of the battery "Vb" 40 flows into ground through the coil 41, the diode 43, the load 50, the diode 46, and the coil 45. If the loss voltage "Vd" of the two diodes is disregarded, the voltage (+Vc) at the terminal "c" is almost at 12 Volts, and the voltage (−Vc) at the terminal "d" is almost at 0 volt. In this state, the power amplifier 22 operates between 0 Volt and 12 Volts, centering on +6 Volts as illustrated in FIG. 6B. The symbol Vth in FIG. 6B represents an ineffective voltage of the power amplifier 22, and the power amplifier 22 cannot produce an output amplitude outside a range determined by subtracting the ineffective voltage Vth from the power-supply voltage (+Vc) being supplied.

An explanation will be further made by using concrete values in order to clarify the operation of the circuit.

Assume that the maximum amplitude voltage of the sinusoidal signal supplied to the input terminal 20 is ±0.8 Volt, the gain "A" of the power amplifier 22 is equal to 6, and the gain "B" of the amplifier 23 is equal to 2, and the attenuation factor "C" of the attenuator "A" 33 is ⅓.

Since the sinusoidal signal supplied to the input terminal 20 is amplified so that its amplitude becomes six times of the original signal by the power amplifier 22, a sinusoidal signal of ±4.8 Volts is produced for the load 30. The sinusoidal signal supplied to the input terminal 20 is amplified so that its amplitude is doubled by the amplifier 23, and a sinusoidal signal of ±1.6 Volts is supplied to the absolute value detection circuit 24. The absolute value detection circuit 24 produces a full-wave rectified signal having a maximum amplitude of 1.6 Volts. The output signal of the absolute value detection circuit 24 is supplied to the comparator as a signal in which the output signal is superimposed on the dc signal from the dc signal source 25.

The dc voltage Vth' is, as described above, a voltage which is 1/C times of the ineffective voltage Vth of the power amplifier 22. Therefore, if Vth is 0.6 Volt, Vth' is equal to 0.2 Volt.

The attenuator 33 connected to the terminal "c", on the other hand, is provided to multiply a value 1/C to a difference voltage between the +Vc (+12 Volts) and the middle point voltage (+6 Volts), the output signal of the attenuator 33 is 2 Volts (+6 Volts×⅓=2 Volts).

To the non-inverting input terminal (+) and inverting input terminal (−) of the comparator 26, a voltage of 1.8 Volts (1.6 Volts+0.2 Volt=1.8 Volts), and a voltage of 2 Volts are supplied respectively, so that the output signal of the comparator 26 at a low level, is supplied to the non-inverting input terminal (+) of the pulse width modulator 27. The pulse width modulator 27 compares the voltage of the triangular signal supplied from the triangular signal generator 28 with the output signal of the comparator 26. The pulse width modulator 27 is designed to produces a pulse signal having a long ON period when the output signal of the comparator 26 is high, and a pulse signal having a short ON period when the output signal of the comparator 26 is low. Therefore, in the case of the condition described above, the output voltage at the terminal "c" of the dual-output booster type chopper circuit 29 is maintained at +12 Volts.

The explanation will be further made for a case that the maximum amplitude voltage of the sinusoidal signal supplied to the input terminal 20 is ±1.9 Volts. Since other conditions are the same, the output voltage of the power amplifier 22 becomes ±11.4 Volts. Similarly, the output voltage of the amplifier 23 becomes ±3.8 Volts, so that the output voltage of the absolute value detection circuit 24 is equal to 3.8 Volts.

Consequently, a voltage of 4.0 Volts (3.8 Volts+0.2 Volt= 4.0 Volts) is supplied to the non-inverting input terminal (+) of the comparator 26.

Since the output voltage at the terminal "c" of the dual-output booster type chopper circuit 29 is maintained at +12 Volts, a voltage of 2 Volts is supplied to the inverting input terminal (−) of the comparator 26. Therefore, the output signal of the comparator 26 becomes a high level, which in tern is supplied to the non-inverting input terminal (+) of the pulse width modulator 27. Therefore, the pulse width modulator 27 receives the signal of the voltage higher than the voltage of the triangular signal supplied from the triangular signal generator 28.

Since the dual-output booster type chopper circuit 29 functions to boost the voltage according to the pulse width, the voltage (+Vc) at the terminal "c" and the voltage (−Vc) at the terminal "d" vary (increase in magnitude) at the same rate. Assume that the voltage at the terminal "c" is boosted by 6 Volts from +12 Volts to +18 Volts, the voltage at the terminal "d" is boosted from 0 Volt to −6 Volts. The center voltage in this state is 6 Volts (18 Volts−(18 Volts+6 Volts) /2). The attenuator 33 performs the attenuation operation by detecting the difference voltage between the center voltage and the voltage of +18 Volts at the terminal "c", the output voltage of the attenuator A 33 becomes 4 Volts, so that the voltages at the two input terminals of the comparator 26 are the same, the relationship between the power source voltage and output signal in this state is shown in FIG. 6B.

As described above, in the power source voltage control circuit a feedback circuit is constituted by the comparator 26, the pulse width modulator 27, the dual-output booster type chopper circuit 29, and the attenuator A33. Therefore, the maximum output voltage required as a power amplifier is previously determined so that the gain "A" of the power amplifier 22, the gain "B" of the amplifier 23, and the attenuation factor "C" of t attenuator 33 can be determined previously. It is also made possible to control of the dual-output booster type chopper circuit 29 according to the signal supplied to its input terminal 20, to allow the supply of the power supply voltage being required.

It is also possible that the attenuator B34 shown in FIG. 3 may be used to control the dual-output booster type chopper circuit 29 relative to the output signal. In this case, the attenuation factor of the attenuator B34 may be the same as that of the attenuator A33.

As described above, the voltage Vth shown in FIGS. 6A and 6B is an ineffective voltage, which has a constant value irrespective of the power supply voltage being supplied, but may be slightly varied depending on the type of the power amplifier utilized, and the amplification fashion.

However, the operation of the circuit according to the present invention can be attained by setting the gains A and B of the power amplifier 22 and the amplifier 23 respectively, and the attenuation factor of the attenuator 33 in the manner described below. That is the attenuation factor C is almost equal to A/B (C≈A/B).

As described in the foregoing, by using the compensated voltage indicated by Vth' (Vth'=Vth/C) as the dc voltage 25 used in the power voltage control circuit, the power supply voltage being required can always be supplied by detecting and monitoring the two input voltages of the comparator 26 provided as the power supply voltage detecting means.

Figure 7:
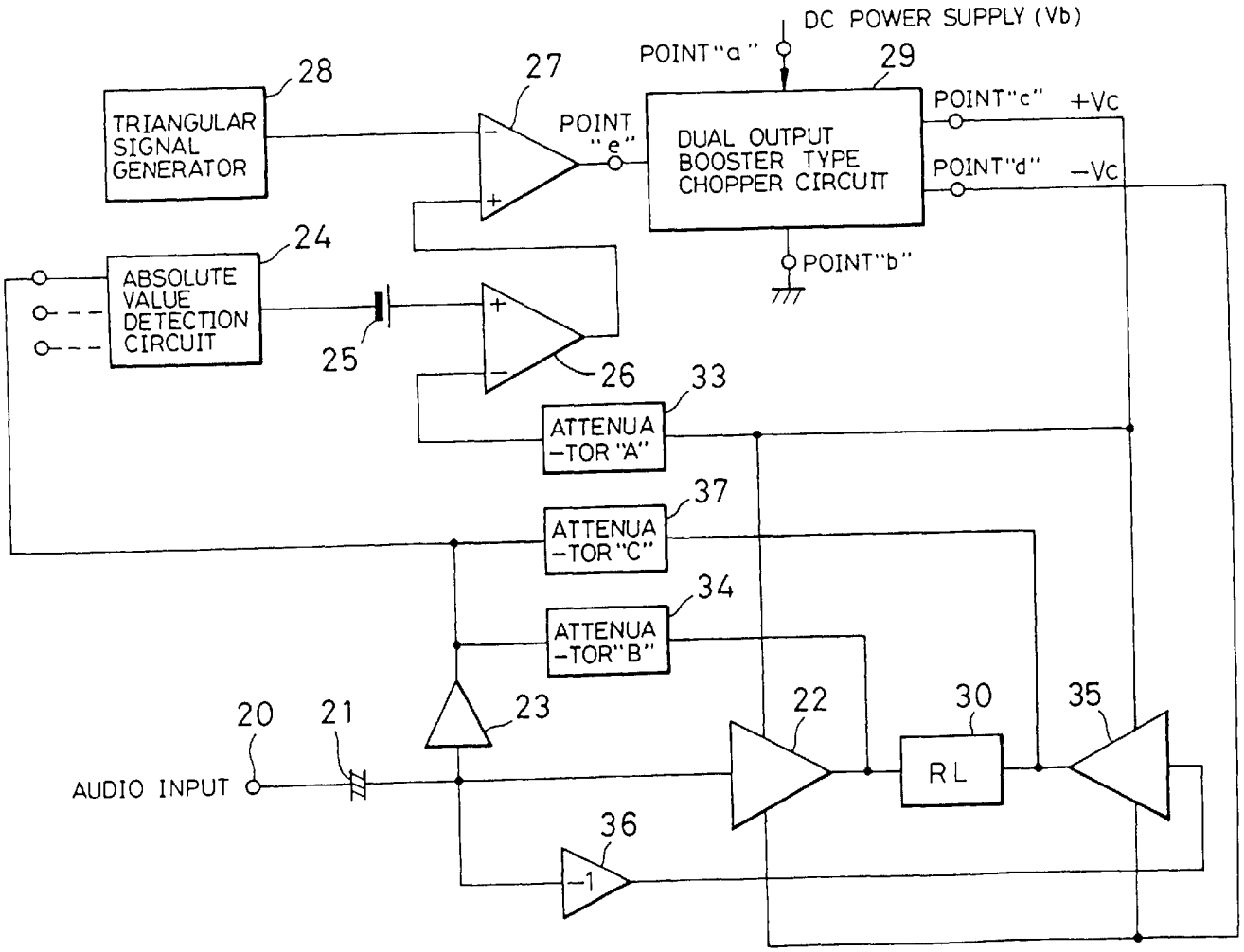
FIG. 7 is a block diagram showing a second embodiment of the power supply voltage control circuit according to the present invention.

FIG. 7 is a block diagram of a second embodiment of the power voltage supply circuit according to the present invention where the power supply circuit and various control means according to the invention are applied in an audio amplifier.

The same reference numerals are used to denote the same or like part of those in the first embodiment, and the explanation thereof will not be repeated.

In contrast to the first embodiment shown in FIG. 3 in which a single power amplifier 22 is used, the second embodiment features that a second power amplifier 35 is provided, so that a BTL (balanced transformerless) driving of the load 30 is performed. For this arrangement, an inverting amplifier 36 having a unity gain is provided to invert the polarity of the audio signal supplied to the input terminal 20, and an attenuator C37 is provided between the output terminal of the second power amplifier 35 and the absolute value detection circuit 24.

Since the gain of the inverting amplifier 36 is set to 1, the operating conditions of the circuit is the same as those in the first embodiment shown in FIG. 3.

The absolute value detection circuit 24 used in the embodiments of the present invention has is provided with a plurality of input terminals in preparation for the application of the circuit in the plural amplifier arrangement. This is because, in such a case that the dual-output booster type chopper circuit 29 according to the present invention is used for a plurality of power amplifiers receiving different input signals, there frequently arises an occasion that although the supply of a low-level power supply voltage is sufficient for one power amplifier which receives the smaller input signal, the other power amplifier which receives a higher input signal requires a higher power supply voltage. By the provision of a plurality of input terminals, which may also be used to detect the signal from the other power amplifiers, to the absolute value detection circuit 24, it is possible to supply the power supply voltage having been boosted for the power amplifier which requires the highest power supply voltage.

Figure 1A:
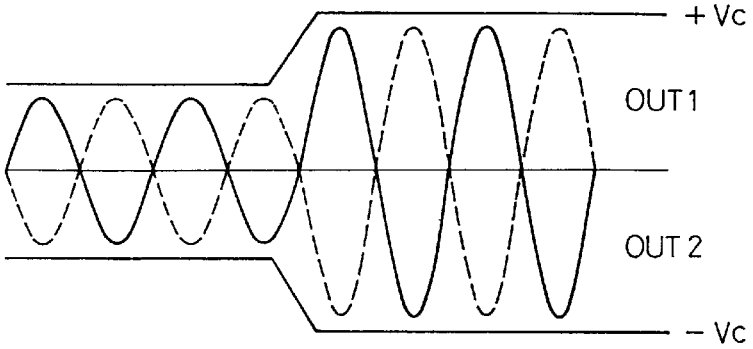
FIG.1A (PRIOR ART)
FIGS. 1A through 1C are diagrams respectively showing the relationship between the output signal and the power supply voltage in an example of conventional power supply voltage control circuit.
Figure 1B:
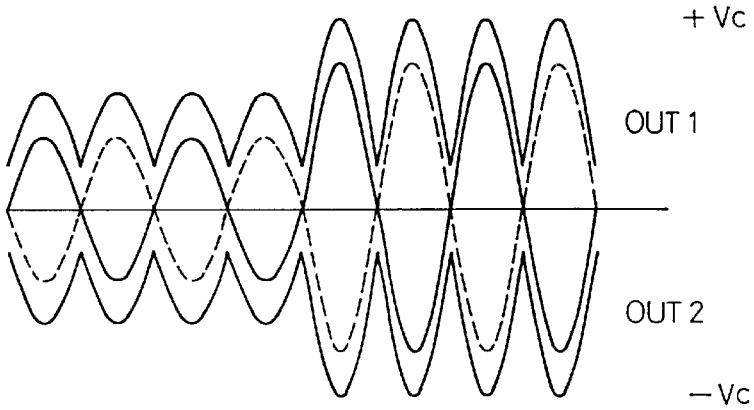
FIG.1B (PRIOR ART)
Figure 1C:
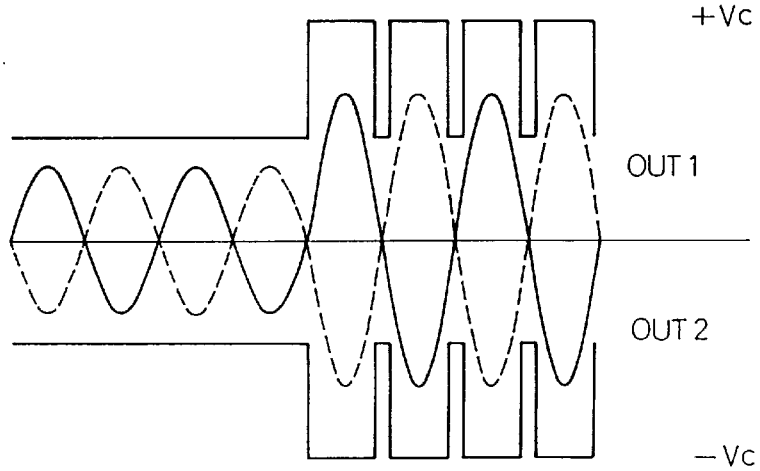
Figure 2:
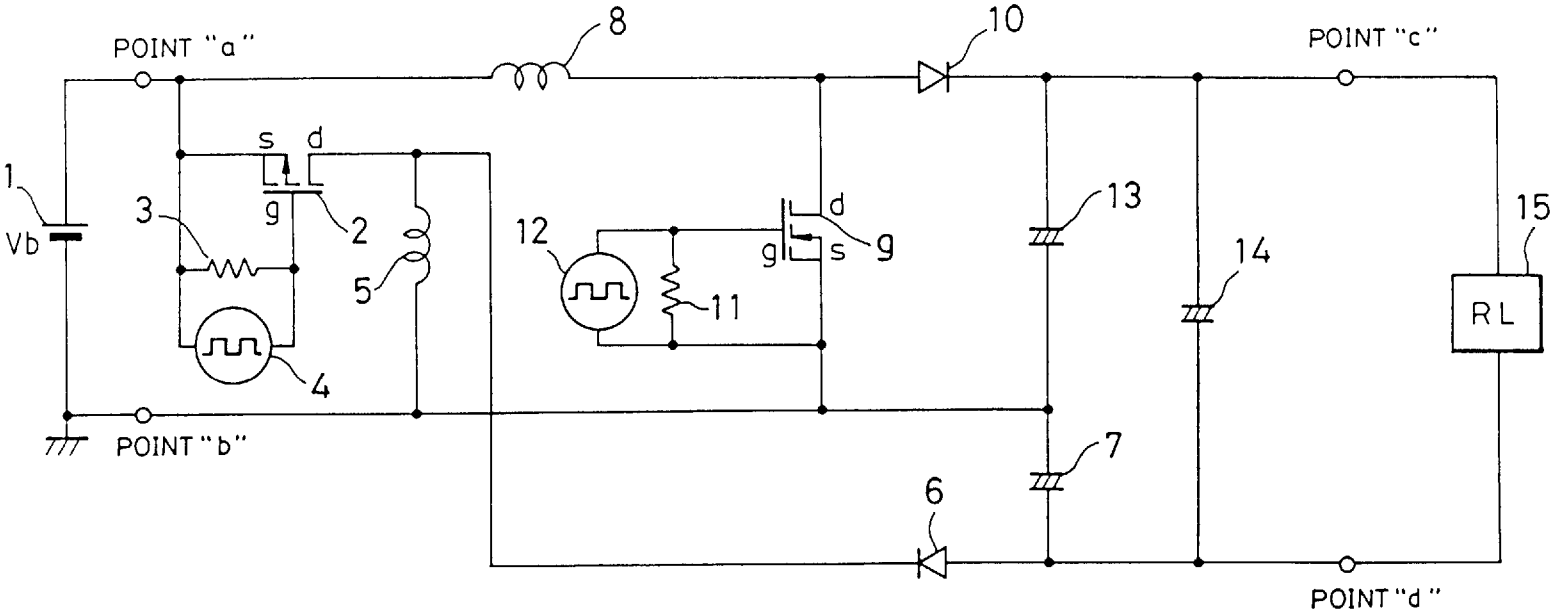
FIG. 2 (PRIOR ART)
FIG. 2 is a block diagram showing a dual-output booster type chopper circuit used in the examples of conventional power supply voltage control circuit.

Although the foregoing explanation has been made to the embodiments of the present invention by way of examples in which the power supply voltage of the dual-output booster type chopper circuit 29 is supplied from a power supply voltage switching scheme, it is needless to mention that various power supply schemes shown in FIGS. 1A through 1C may be used depending on the form (analog form or digital form) of the output voltage of the comparator circuit 26 to be presented in the power supply voltage control circuit, and the method of the comparison of input signal of the pulse width modulation circuit 27.

Since the dual-output booster type chopper circuit used in the embodiments of the present invention is constituted in such a way that the coil "L2" 41, diode "D2" 43 and capacitor "C2" 48 for the plus voltage, and the coil "L1" 45, diode "D1" 46, and capacitor "C1" 47 for the minus voltage are formed by couples of parts which are almost the same like L1=L2, D1=D2, C1=C2, and the switching is performed by using a single FET 42, the boosting values of the plus voltage and the minus voltages can be made almost the same. Moreover, only a single since the switch element is used, an overall characteristic of the dual-output booster type chopper circuit can be made uniform, so that a low-cost power supply circuit which can be made small in size is provided.

Since almost the same current flows through the coils L1 and L2, those coils can be wound on the same core (a single core such as a troidal core), so that the same inductance can be easily obtained (L1=L2). This allows the uniformalizing of the overall characteristic of the dual output booster type chopper circuit.

The preferred embodiments of the present invention have been made. It will be understood that various modifications and variations will occur to those skilled in the art. It is intended that all of such modifications and variations are within the scope of claims of the invention.

What is claimed is:

1. A power supply circuit for generating a power-supply voltage to be supplied to an amplification unit which amplifies an input signal, comprising:

a DC (direct current) voltage source;

a first coil having a first terminal connected to a terminal of said DC voltage source and a second terminal connected to an anode of a first diode;

a second coil having a first terminal connected to another terminal of said DC voltage source and a second terminal connected to a cathode of a second diode;

a first capacitor connected to a cathode of said first diode and said another terminal of said DC voltage, which accumulates a counter electromotive force generated in said first coil;

a second capacitor connected to an anode of said second diode and said another terminal of said DC voltage, which accumulates a counter electromotive force generated in said second coil;

opening and closing means connected across said anode of said first diode and said cathode of said second diode, for performing an opening and closing operation;

opening and closing control means connected to said opening and closing means, for controlling said opening and closing operation of said opening and closing means; and an amplification means connected across a cathode of said first diode and an anode of said second diode.

2. A power supply circuit as claimed in claim 1, wherein said opening and closing means comprises:

a signal level detecting means for detecting a level of an input signal of said amplification means;

a power supply voltage detecting means for detecting a power supply voltage supplied to said amplification means;

an attenuating means for attenuating said power supply voltage having been detected at a predetermined attenuation factor; and a control signal generating means for generating a control signal which controls said opening and closing operation of said opening and closing means based on a result of a comparison between an output signal of said attenuating means and said input signal level having been detected.

3. A power supply circuit as claimed in claim 1, wherein said opening and closing means comprises:

a signal level detecting means for detecting a level of an output signal of said amplification means;

a power supply voltage detecting means for detecting a power supply voltage supplied to said amplification means;

a first attenuating means for attenuating said power supply voltage having been detected at a predetermined attenuation factor; and a second attenuating means for attenuating said level of said output signal having been detected at said predetermined attenuation factor; and a control signal generating means for generating a control signal which controls said opening and closing operation of said opening and closing means based on a result of a comparison between an output signal of said first attenuating means and an output signal of said second attenuating means.

* * * * *